US010474053B2

(12) United States Patent
Sakano et al.

(10) Patent No.: US 10,474,053 B2
(45) Date of Patent: Nov. 12, 2019

(54) IMAGE FORMING APPARATUS

(71) Applicant: CANON KABUSHIKI KAISHA, Tokyo (JP)

(72) Inventors: Toru Sakano, Naka-gun (JP); Hiroki Kasama, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/143,297

(22) Filed: Sep. 26, 2018

(65) Prior Publication Data

US 2019/0121253 A1 Apr. 25, 2019

(30) Foreign Application Priority Data

Oct. 25, 2017 (JP) ..... 2017-206272

(51) Int. Cl.
*G03G 15/02* (2006.01)
*G03G 15/00* (2006.01)
*G03G 15/16* (2006.01)

(52) U.S. Cl.
CPC ..... *G03G 15/0216* (2013.01); *G03G 15/165* (2013.01); *G03G 15/602* (2013.01); *G03G 15/6573* (2013.01)

(58) Field of Classification Search
CPC . G03G 15/0216; G03G 15/165; G03G 15/602
See application file for complete search history.

(56) References Cited

U.S. PATENT DOCUMENTS 9,298,155 B2 * 3/2016 Ishimitsu ..... G03G 21/1633
2015/0110517 A1 * 4/2015 Ishida ..... G03G 21/206 399/91
2015/0338761 A1 * 11/2015 Watanabe ..... G03G 15/04 347/118
2016/0161904 A1 * 6/2016 Matsuda ..... G03G 15/6552 399/91
2017/0108812 A1 * 4/2017 Niitsuma ..... B65H 5/38
2017/0260015 A1 * 9/2017 Shimazu ..... B65H 5/36
2019/0137912 A1 * 5/2019 Kasama ..... G03G 15/2028

* cited by examiner

*Primary Examiner* — G. M. A Hyder
(74) *Attorney, Agent, or Firm* — Canon U.S.A., Inc. IP Division

(57) ABSTRACT

An image forming apparatus includes a transfer unit to transfer a toner image onto a sheet, a fusing unit, a discharging unit to discharge the sheet passed through the fusing unit, a guide member having a through-hole at a conveying surface and provided downstream of the fusing unit and upstream of the discharging unit in a conveying direction of the sheet, and a Helmholtz resonator. The Helmholtz resonator includes a cavity portion and communicating portions through which the cavity portion is in communication with an outside area. The Helmholtz resonator and a conveying path of the sheet guided by the guide member are connected through the through-hole. The Helmholtz resonator is disposed on a downstream side with respect to the fusing unit and on an upstream side with respect to the discharging unit in the conveying direction of the sheet, and the communicating portion is disposed facing the guide member.

18 Claims, 10 Drawing Sheets

IMAGE FORMING APPARATUS

BACKGROUND OF THE INVENTION

Field of the Invention

This present disclosure relates to an image forming apparatus including a Helmholtz resonator.

Description of the Related Art

An image forming apparatus, such as a copying machine or a printer, generates operating sound due to the operation of a motor or a fan during image forming. Meanwhile, rendering the image forming apparatus in noise reduction is strongly required in order to meet recent customer needs.

As a configuration of reducing the operating sound of the image forming apparatus, an image forming apparatus including a Helmholtz resonator serving as a sound suppressing device, has been proposed (US Patent Application Pub. No. 2016/0161904). The Helmholtz resonator has: a cavity portion determined in volume on the basis of a frequency band to be suppressed; and a communicating portion through which the cavity portion is communication with the outside.

The image forming apparatus described in US Patent Application Pub. No. 2016/0161904, has the Helmholtz resonator disposed on the top face (bottom face of a scanner) of an in-body sheet discharging unit, at a long distance from a discharging port.

SUMMARY OF THE INVENTION

The present disclosure is directed to providing an image forming apparatus capable of effectively suppressing sound to be emitted from a discharging port of the image forming apparatus, with a Helmholtz resonator.

According to an aspect of the present disclosure, an image forming apparatus includes a transfer unit configured to transfer a toner image onto a sheet, a fusing unit configured to fuse the toner image on the sheet, a discharging unit configured to discharge the sheet passed through the fusing unit, a guide member provided downstream of the fusing unit and upstream of the discharging unit in a conveying direction of the sheet, wherein the guide member includes a through-hole at a conveying surface, and a Helmholtz resonator having a cavity portion and a communicating portion through which the cavity portion is configured to be in communication with an outside area that is exterior to the Helmholtz resonator, wherein the Helmholtz resonator and a conveying path of the sheet guided by the guide member are connected through the through-hole, and wherein the Helmholtz resonator is disposed on a downstream side with respect to the fusing unit and on an upstream side with respect to the discharging unit in the conveying direction of the sheet, and the communicating portion is disposed facing the guide member.

According to the one embodiment of the present disclosure, sound to be emitted from a discharging port of the image forming apparatus can be effectively suppressed by the Helmholtz resonator.

Further features of the present disclosure will become apparent from the following description of embodiments (with reference to the attached drawings).

DESCRIPTION OF THE EMBODIMENTS

First Embodiment

Figure 1:
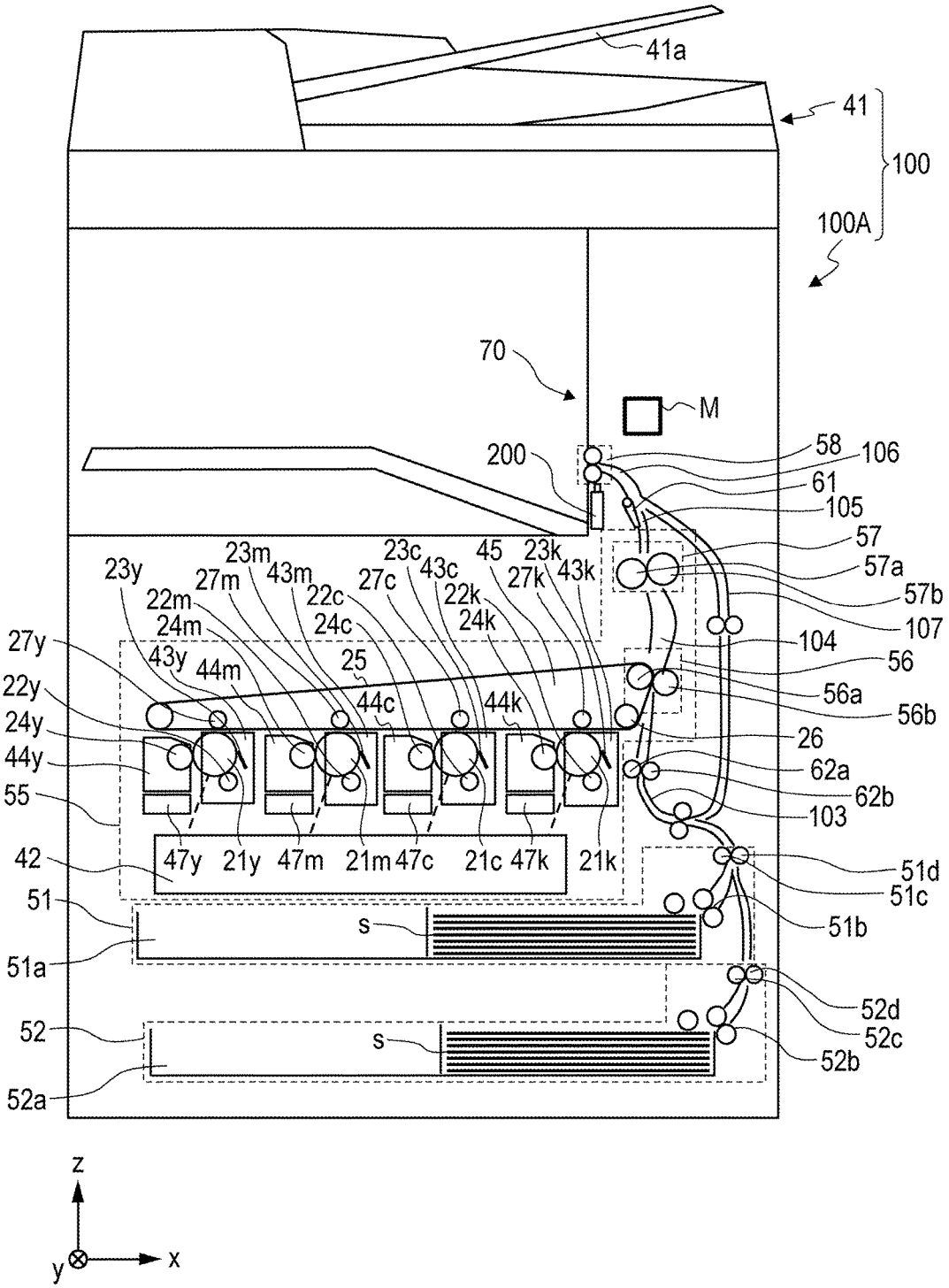
FIG. 1 is a schematic view of an image forming apparatus including a Helmholtz resonator in a first embodiment.

The present disclosure will be described in detail below with reference to the drawings. Note that the disclosure according to the claims is not limited to the following embodiments, and thus each image forming apparatus to be described later, having an electrophotographic type process as an example, will be given.

The entire configuration of an image forming apparatus 100 will be described on the basis of FIG. 1. The x direction, the y direction, and the z direction represent the right-and-left direction, the near-and-far direction, and the height direction of the image forming apparatus 100, respectively. Similarly, the definition in direction is applied to other figures, such as FIG. 3. The image forming apparatus 100 includes an image forming apparatus main body 100A (hereinafter, referred to as an apparatus main body) and an image reading unit 41 that reads an image formed on a sheet (hereinafter, referred to as an original). The image reading unit 41 includes: an image sensor that reads the image on the original and converts the image into a digital signal; and an automatic original conveying device 41*a* that automatically conveys the original placed on an original stand to the reading position of the image sensor. The automatic original conveying device 41*a* conveys the original from which the image is to be read, to the reading position on a platen glass. The apparatus main body 100A is provided with an image formation unit 55 and sheet feeding devices 51 and 52 each that feed a sheet s to the image formation unit 55.

The image formation unit 55 will be described. The image formation unit 55 has a configuration for forming images in the respective colors of yellow (Y), magenta (M), cyan (C), and black (Bk). In a case where the respective configurations for the colors are distinguished, the descriptions are given with reference numerals denoted with Y, M, C, and Bk. In a case where the respective configurations for the colors are not distinguished, the denotations thereof will be omitted.

The image formation unit 55 includes an exposure unit 42, photoconductive drum cartridges 43 (43*y*, 43*m*, 43*c*, and 43*k*) and four developing cartridges 44 (44*y*, 44*m*, 44*c*, and 44*k*). The image formation unit 55 includes an intermediate transfer unit 45, a secondary transfer unit 56, and a fusing unit 57, each being disposed above the photoconductive drum cartridges 43 and the developing cartridges 44.

The photoconductive drum cartridges 43 include photoconductive drums 21 (21*y*, 21*m*, 21*c*, and 21*k*), charging rollers 22 (22*y*, 22*m*, 22*c*, and 22*k*), and drum cleaning blades 23 (23*y*, 23*m*, 23*c*, and 23*k*). The photoconductive drum cartridges 43 are detachably attachable to the apparatus main body 100A.

The developing cartridges 44 include developing rollers 24 (24*y*, 24*m*, 24*c*, and 24*k*). The developing cartridges 44 detachably attachable to the apparatus main body 100A, are supported by developing cartridge supporting members 47 (47*y*, 47*m*, 47*c*, and 47*k*) installed in the apparatus main body 100A.

The intermediate transfer unit 45 includes: an intermediate transfer belt 25 stretched by, for example, a belt driving roller 26 and an inner secondary transfer roller 56*a*; and primary transfer rollers 27 (27*y*, 27*m*, 27*c*, and 27*k*) abutting on the intermediate transfer belt 25 at positions opposed to the photoconductive drums 21. As to be described later, the primary transfer rollers 27 each apply a positive-polarity transfer bias to the intermediate transfer belt 25, so that respective negative-polarity toner images on the photoconductive drums 21 are sequentially transferred to the intermediate transfer belt 25 such that the toner images are overlaid one on another. This arrangement forms a full-color image on the intermediate transfer belt 25.

The secondary transfer unit 56 includes the inner secondary transfer roller 56*a* and an outer secondary transfer roller 56*b* in contact with the inner secondary transfer roller 56*a* through the intermediate transfer belt 25. As to be described later, a positive-polarity secondary transfer bias is applied to the outer secondary transfer roller 56*b*, so that the full-color image formed on the intermediate transfer belt 25, is transferred to a sheet s.

The fusing unit 57 includes a fusing roller 57*a* and a fusing backup roller 57*b*. Nipping and conveying of the sheet s between the fusing roller 57*a* and the fusing backup roller 57*b*, subjects the tonner images on the sheet s to pressing and heating, so that the tonner images are fused on the sheet s.

The sheet feeding device 51 includes a cassette 51*a*, a sheet separating and feeding portion 51*b*, and drawing roller pair 51*c* and 51*d*. The sheet feeding device 52 includes a cassette 52*a*, a sheet separating and feeding portion 52*b*, and drawing roller pair 52*c* and 52*d*. The cassettes 51*a* and 52*a* each are a housing unit that houses sheets s. The sheet separating and feeding portions 51*b* and 52*b* separate the respective sheets s housed in the cassettes 51*a* and 52*a* one sheet by one sheet with frictional force, and then each performs feeding to the downstream side in a sheet conveying direction. The drawing roller pair 51*c* and 51*d* further conveys a sheet s conveyed by the sheet separating and feeding portion 51*b*, downstream in the sheet conveying direction. The drawing roller pair 52*c* and 52*d* further convey a sheet s conveyed by the sheet separating and feeding portion 52*b*, downstream in the sheet conveying direction.

A pre-secondary-transfer conveying path 103 conveys the sheet s fed from the cassette 51*a* or 52*a*, to the secondary transfer unit 56. A pre-fusing conveying path 104 conveys the sheet s conveyed to the secondary transfer unit 56, from the secondary transfer unit 56 to the fusing unit 57. A post-fusing conveying path 105 conveys the sheet s conveyed to the fusing unit 57, from the fusing unit 57 to a switching member 61. A sheet ejection path 106 conveys the sheet s conveyed to the switching member 61, from the switching member 61 to a discharging port 58. The switching member 61 including, for example, a flapper guides the sheet s from the post-fusing conveying path 105 to the sheet ejection path 106. In a case where an image is formed on each face of a sheet, the conveying direction of the sheet s guided to the sheet ejection path 106, is reversed and then the sheet s is conveyed to a re-conveying path 107. The switching member 61 can move to switch in position between conveying of the sheet s from the post-fusing conveying path 105 to the sheet ejection path 106 and conveying of the sheet s from the sheet ejection path 106 to the re-conveying path 107.

Next, the image forming operation of the image forming apparatus 100 having the configuration, will be described. Note that a process in which image forming is performed to a sheet, is shared between a sheet to be conveyed from the cassette 51*a* and a sheet to be conveyed from the cassette 52*a*. Thus, in a case where no particular distinction is required, the description will be given on the basis of a sheet to be fed from the cassette 51*a*.

When the image forming operation starts, the exposure unit 42 irradiates the surfaces of the photoconductive drums 21 with laser light, on the basis of image information from, for example, a personal computer not illustrated. In this case, the irradiation of the laser light to the surfaces of the photoconductive drums 21 uniformly charged at a predetermined polarity and a predetermined potential by the charging rollers 22, attenuates charges at the regions irradiated with the laser light, so that an electrostatic latent image is formed on the surface of each of the photoconductive drums 21.

After that, with application of a predetermined potential to each of the developing rollers 24, toner of each of the yellow (Y), the magenta (M), the cyan (C), and the black (Bk) from the developing rollers 24 is supplied, so that the electrostatic latent image is developed as a toner image. Then, the toner images in the colors are sequentially transferred to the intermediate transfer belt 25, by the respective primary transfer biases applied to the primary transfer rollers 27, so that a full-color toner image is formed on the intermediate transfer belt 25.

Meanwhile, in parallel to the toner image forming operation, the sheet separating and feeding portion 51*b* in the sheet feeding device 51 separates and feeds only one sheet s from the cassette 51*a*. After that, the sheet s reaches the drawing roller pair 51*c* and 51*d*. Furthermore, the sheet s nipped by the drawing roller pair 51*c* and 51*d* is sent to the pre-secondary-transfer conveying path 103 and abuts on registration roller pair 62*a* and 62*b* at rest, so that the leading end of the sheet s is adjusted in position.

Next, the registration roller pair 62*a* and 62*b* are driven at the timing at which the position of the full-color toner image on the intermediate transfer belt 25 and the position of the sheet s are to agree with each other at the secondary transfer unit 56. This arrangement allows the sheet s to be conveyed to the secondary transfer unit 56. The full-color toner image is collectively transferred onto the sheet s by the secondary transfer bias applied to the outer secondary transfer roller 56*b* at the secondary transfer unit 56.

The sheet s having the full-color toner image transferred thereto, is conveyed to the fusing unit 57. The toner of the colors is fused and color-mixed by reception of heat and pressure at the fusing unit 57, and then the full-color toner image is fused as a full-color image on the sheet s. After that, a drive transmitting mechanism not illustrated, transmits the drive of a driving source M to discharging rollers 58*a* and 58*b* provided in the neighborhood of the discharging port 58.

Then, the sheet s having the image fused thereon is discharged from the discharging port 58 formed by an external member 70.

Figure 2:
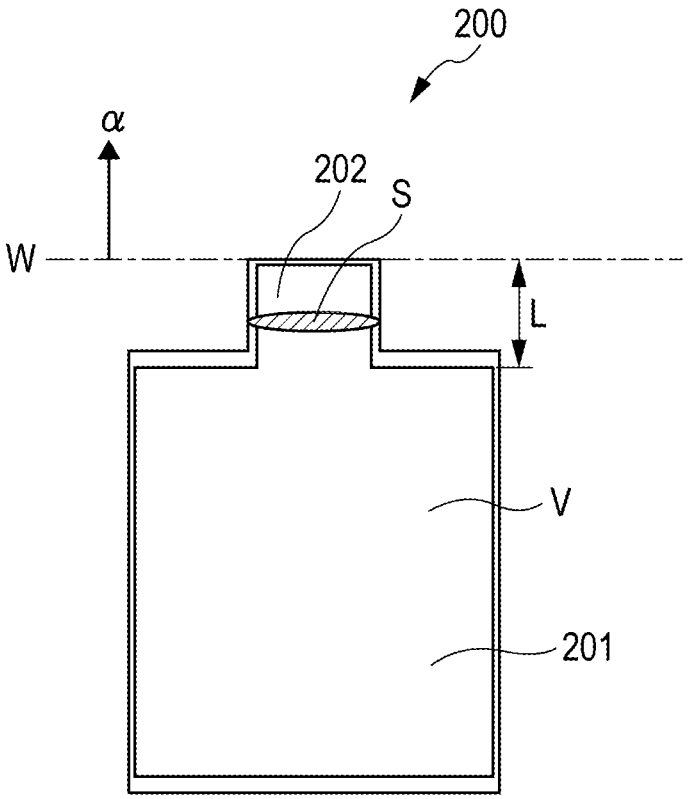
FIG. 2 is a schematic view of the Helmholtz resonator.

When air passes over or in a cavity, the passing air may cause the cavity to oscillate with increased amplitude at specific frequencies. The phenomenon, called Helmholtz resonance, may also be indicted by a vibrating system or force external applied to the cavity. The structure of a Helmholtz resonator 200 included in the image forming apparatus 100 of the first embodiment of the present disclosure, will be described with FIG. 2. FIG. 2 is a schematic view of the Helmholtz resonator 200.

The Helmholtz resonator 200 mainly has: a cavity portion 201 having a volume V of space; and a communicating portion 202 extending by a length L from the cavity portion 201, the communicating portion 202 having an opening having a sectional area S. Vibration of a mass of air in the communicating portion 202 by an air spring formed with the space of the cavity portion 201, causes resonance to occur, so that a specific frequency f of sound that enters in the communicating portion 202 is suppressed. The specific frequency f to be suppressed is expressed by Expression (1):

[Mathematical Formula 1] (1)

$$f = \frac{c}{2\pi}\sqrt{\frac{S}{V(L+\Delta L)}}$$

where c represents the speed of sound, L represents the length of the communicating portion 202, and ΔL represents an open-end correction. ΔL is 1.6a (a represents the radius in a case where the section of the communicating portion 202 is circular).

From the inside of the image formation unit 55, various types of sound are generated, such as aerodynamic sound due to a fan, sound from a sheet being conveyed, and driving sound due to a drive motor that is a driving source. Inevitably, the types of sound leak integrally from the discharging port 58 provided as an opening, resulting in noise. In particular, because the image formation unit 55 includes a large number of drive motors, the driving sound of the drive motors account for a large rate of the noise leaking from the discharging port 58.

In the present embodiment, in particular, the driving sound of the drive motor M that is a sound source near the discharging port 58 is an object to be suppressed. The parameters of the Helmholtz resonator 200 are determined such that the frequency of high-frequency sound to be generated and the specific frequency f in Expression (1) are in agreement.

The specific configuration of the image forming apparatus according to the first embodiment of the present disclosure, will be described with FIGS. 1 and 3.

FIG. 1 is a schematic view of the image forming apparatus 100 to which the present disclosure has been applied.

As described above, the sheet s after the image fusing at the fusing unit 57, is discharged from the discharging port 58 through the post-fusing conveying path 105 and the sheet ejection path 106. In an example, noise due to a drive motor for conveying a sheet s leaks from the opening portion of the discharging port 58. In particular, a user is annoyed at noise having a driving sound of approximately 500 Hz due to the drive motor M provided in the neighborhood of the discharging port 58. Thus, for the Helmholtz resonator 200 of the present embodiment, the parameters are determined with a frequency in the neighborhood of 500 Hz as the specific frequency f. The Helmholtz resonator 200 of the present embodiment, has the communicating portion 202 cylindrical and the cavity portion 201 cuboid. The zealous study of the inventors has found that a Helmholtz resonator has a sound-suppression effect decreasing as the energy of sound flowing inside the Helmholtz resonator, decreases. Thus, the sound-suppression effect of the Helmholtz resonator decreases as the Helmholtz resonator moves away from a sound source to be suppressed or as the degree of open space increases between the Helmholtz resonator and the sound source. Thus, a sufficient sound-suppression effect is not acquired with a configuration in which the Helmholtz resonator is disposed on the top face (bottom face of a scanner) of an in-body sheet discharging unit, at a long distance from a discharging port.

Figure 3:
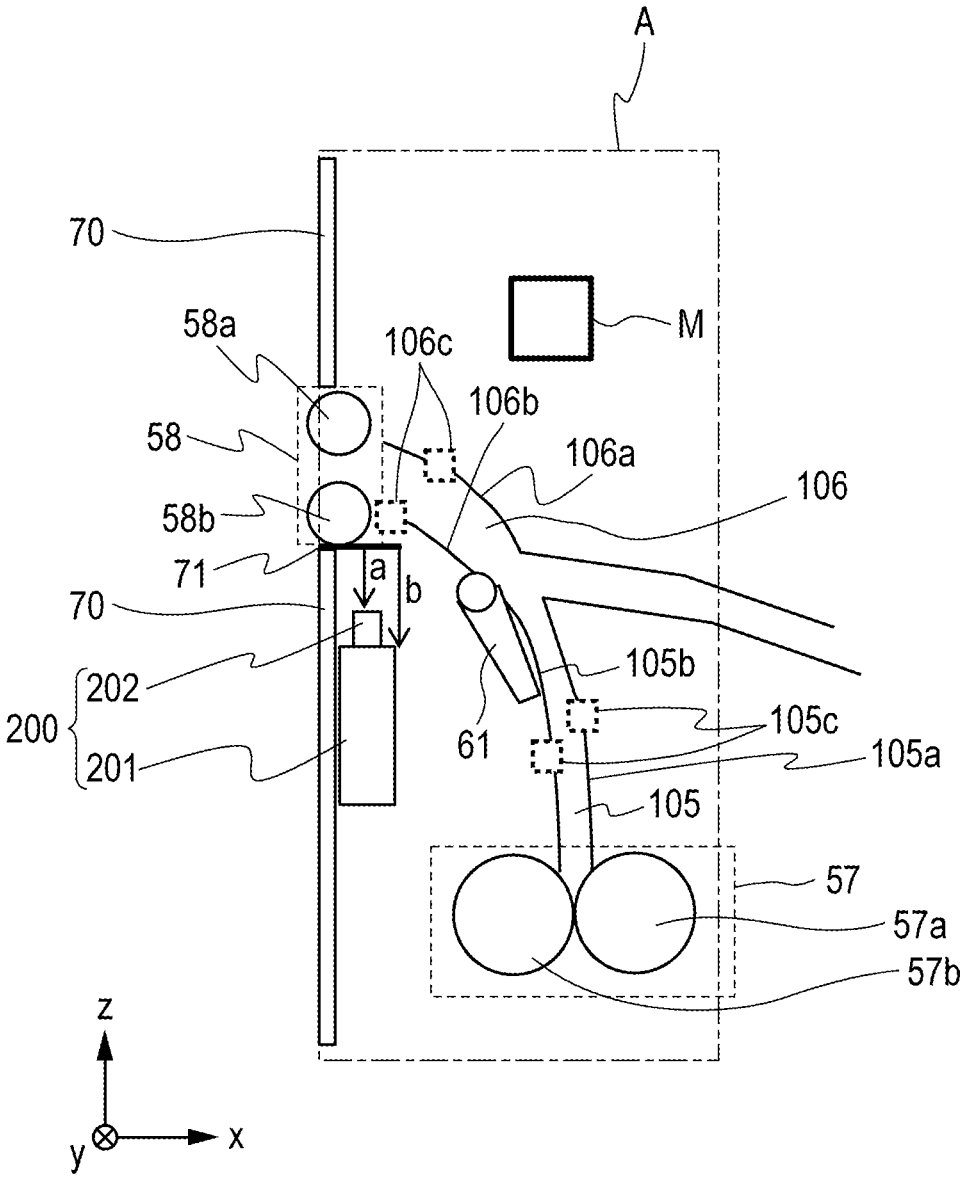
FIG. 3 is a schematic view of a portion in the neighborhood of a discharging port in the first embodiment.

FIG. 3 is an enlarged view of the neighborhood of the fusing unit 57 and the discharging port 58. In order to release heat or vapor generated from the sheet s after the fusing during conveying, post-fusing conveying guides 105*a* and 105*b* forming the post-fusing conveying path 105, are each provided with a through-hole 105*c* and sheet discharging guides 106*a* and 106*b* forming the sheet ejection path 106, are each provided with a through-hole 106*c*. The through-holes 105*c* and 106*c* each have a plurality of through-holes provided in the y direction. The post-fusing conveying guides 105*a* and 105*b* and the sheet discharging guides 106*a* and 106*b* are examples of a guide member of the present embodiment.

When viewed in the rotational axial direction (y direction) of the discharging rollers 58*a* and 58*b*, the Helmholtz resonator 200 is disposed in space A on the downstream side with respect to the fusing unit 57 and on the upstream side with respect to the external member 70 forming the discharging port 58, in the conveying direction of the sheet s. The space A includes space in the neighborhood of the sheet ejection path 106, downstream of the fusing unit 57 in the conveying direction of the sheet s. The disposition of the Helmholtz resonator 200 in the space A means that the Helmholtz resonator 200 is disposed in the neighborhood of the discharging port 58, inside the apparatus main body 100A. The disposition of the Helmholtz resonator 200 in this manner, allows sound suppression to be performed effectively, as to be described later.

The Helmholtz resonator 200 is secured with adhesion to the external member 70. The opening side of the communicating portion 202 of the Helmholtz resonator 200 is disposed facing the sheet discharging guide 106*b* and the discharging port 58. Here, the facing of the opening side of the communicating portion 202 to the discharging port 58 indicates, in a case where an apparent line W is drawn so as to pass through the opening plane of the communicating portion 202 (refer to FIG. 2), a situation in which the discharging port 58 is disposed in a region a on the opposite side of the Helmholtz resonator 200 with respect to the apparent line W. The distance between the plane on the near side to the discharging port 58, of the communicating portion 202 of the Helmholtz resonator 200 and a face 71 that is the end face on the near side to the Helmholtz resonator 200, of the external member 70 forming the discharging port 58, is defined as a distance a. The distance between the face on the near side to the discharging port 58, of the cavity portion 201 and the face 71, is defined as a distance b. In this case, the Helmholtz resonator 200 is disposed such that the distance a is shorter than the distance b. The communicating portion 202 is disposed in the neighborhood of the through-hole 106*c* provided at the sheet discharging guide 106*b* forming the sheet ejection path 106. The communicating portion 202 is spatially in communication with the sheet ejection path 106 through the through-hole 106*c*. Note that, even in a case where the Helmholtz resonator 200 is housed inside enclosed space, such as a frame, if the sheet discharging guide 106*b* having the through-hole 106*c* is located inside the enclosed space, it can be said that the spatial communication is established.

The driving sound generated by the drive motor M, tends to be emitted to the discharging port 58 through the through-hole 106*c*. Once the driving sound is emitted outward from the discharging port 58 and then is spread, the sound-suppression effect of the Helmholtz resonator 200 on the driving sound decreases. However, the disposition of the Helmholtz resonator 200 as in the present embodiment, causes the driving sound to flow into the communicating portion 202 through the through-hole 106*c* before the driving sound is spread. Thus, the driving sound can be effectively suppressed.

Note that, in the present embodiment, a target frequency is the driving sound due to the drive motor M, but is not limited to this. Alternatively, the parameters of the Helmholtz resonator 200 may be set on the basis of the frequency of a sound source corresponding to noise to be reduced. The Helmholtz resonator 200 in shape is not limited to having a cylindrical communicating portion and a cuboid cavity portion. The method of securing the Helmholtz resonator 200 is not limited to the adhesion to the discharging port external member 70, and thus may include fastening fixation with screws or engagement fixation with projections. In the present embodiment, the example in which the Helmholtz resonator 200 is disposed at the lower portion of the discharging port 58, has been given, but the Helmholtz resonator 200 may be provided on the upper-portion side of the discharging port 58 (on the upper-portion side of the external member 70). Note that, in the case of the provision on the upper-portion side the discharging port 58, the Helmholtz resonator 200 is attached upside down such that the communicating portion 202 faces the sheet ejection path 106. A plurality of Helmholtz resonators 200 may be provided so as to be arrayed and disposed in the y direction of FIG. 1 (in the rotational axial direction of the discharging rollers 58*a* and 58*b*). A plurality of Helmholtz resonators 200 may be provided so as to be disposed in the z direction of FIG. 1 (in the height direction of the apparatus main body 100A). A plurality of Helmholtz resonators 200 may be provided so as to be disposed in the x direction of FIG. 1 (in the direction orthogonal to the rotational axial direction of the discharging rollers 58*a* and 58*b* and the height direction).

Second Embodiment

A second embodiment will be described with FIG. 4. The second embodiment is different from the first embodiment in terms of the disposition of a Helmholtz resonator 200. The descriptions for configurations similar to those of the first embodiment, will be omitted.

Figure 4:
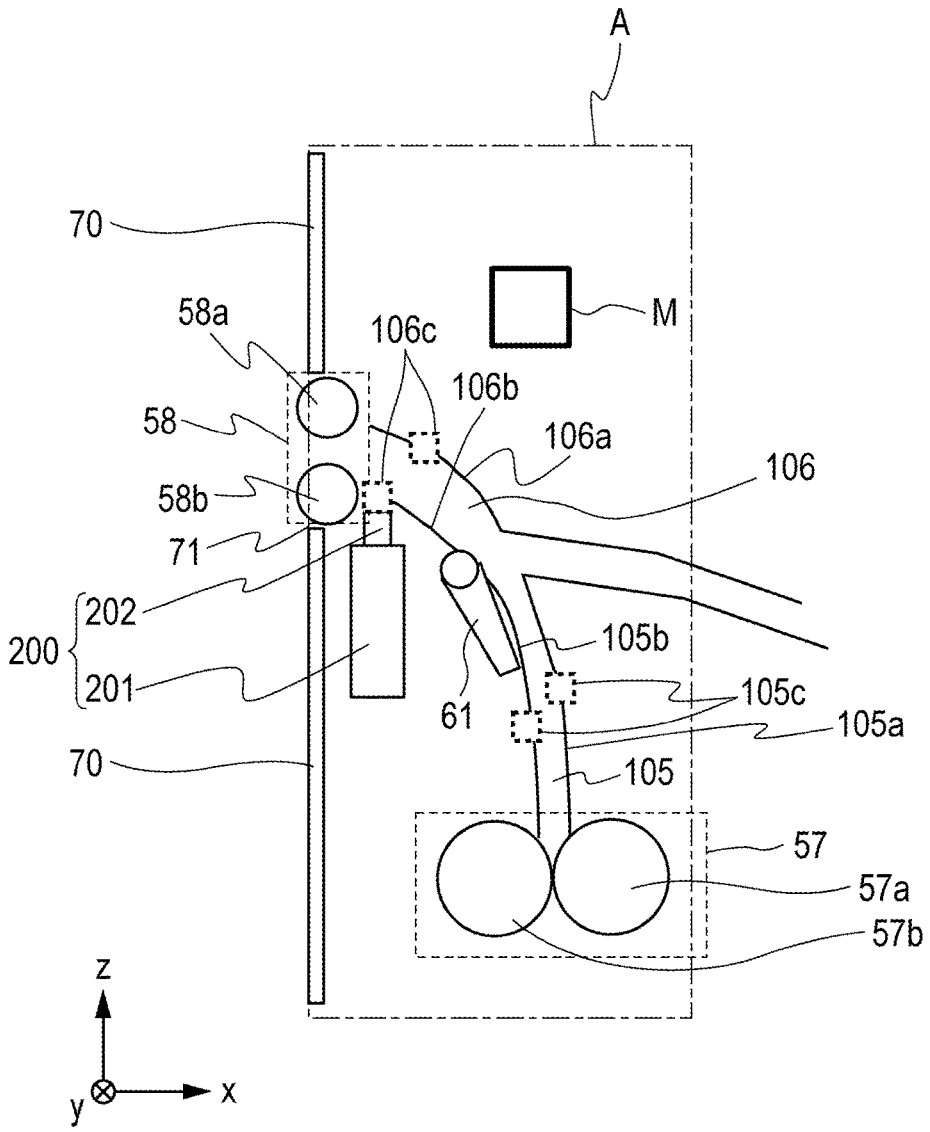
FIG. 4 is a schematic view of a portion in the neighborhood of a discharging port in a second embodiment.

FIG. 4 is an enlarged view of the neighborhood of a fusing unit 57 and a discharging port 58. The Helmholtz resonator 200 is secured to an external member 70 forming the discharging port 58. The second embodiment is different from the first embodiment in that the Helmholtz resonator 200 is provided in contact with a sheet discharging guide 106*b* forming a sheet ejection path 106. A through-hole 106*c* formed at the conveying surface of the sheet discharging guide 106*b* and a communicating portion 202 of the Helmholtz resonator 200 are spatially in direct connection. In other words, the end portion of the communicating portion 202 of the Helmholtz resonator 200 and an end portion of the through-hole 106*c* of the sheet discharging guide 106*b* are provided in connection with each other. Thus, the distance between the communicating portion 202 and a face 71 of the external member 70 forming the discharging port 58, is short.

The disposition of the Helmholtz resonator 200 in this manner, has a benefit that space in the z direction can be used more effectively in comparison to the first embodiment. The distance from the through-hole 106*c* to the communicating portion 202, shorter than that of the first embodiment, allows driving sound to flow into the Helmholtz resonator 200 before the driving sound is spread and the energy of sound decreases. Thus, the sound-suppression effect is larger than that of the first embodiment.

Note that, as described in the first embodiment, the method of securing the Helmholtz resonator 200 and the shape of the Helmholtz resonator 200 can be appropriately changed.

Third Embodiment

A third embodiment will be described with FIGS. 5 to 7. The third embodiment is different from the first embodiment in terms of part of the configuration of an image forming apparatus 100 and the disposition of a Helmholtz resonator 200. The descriptions for configurations similar to those of the first embodiment, will be omitted.

Figure 5:
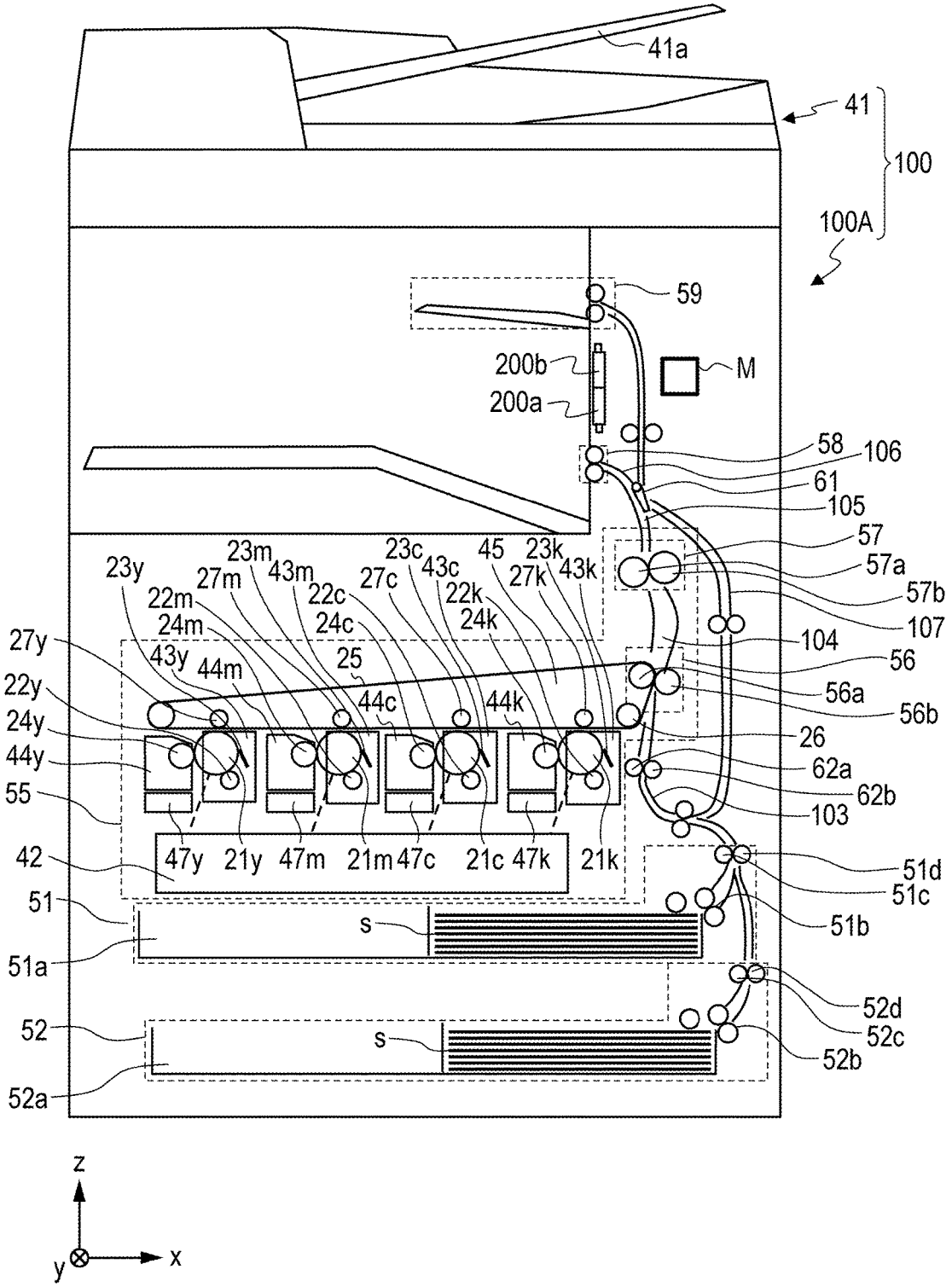
FIG. 5 is a schematic view of an image forming apparatus including Helmholtz resonators in a third embodiment.

FIG. 5 is a schematic view of the image forming apparatus 100 in the third embodiment. A reversing unit 59 is provided in the third embodiment. The reversing unit 59 is used in a case where an image is formed on each face of a sheet s. A post-fusing conveying path 105 branches into a sheet ejection path 106 and a reversing path 108, on the downstream side of a switching member 61 in a sheet conveying direction. The switching member 61 including, for example, a flapper is disposed at a branch portion between the sheet ejection path 106 and the reversing path 108. The switching member 61 is switchable in position, and switches on the basis of whether the sheet s is to be conveyed to the sheet ejection path 106 or to the reversing path 108. The reversing path 108 conveys the sheet s to the reversing unit 59. The reversing path 108 is provided with reversing path guides 108*a* and 108*b*. The reversing path guides 108*a* and 108*b* each are provided with a through-hole 108*c* in order to release heat or vapor generated from the sheet s after fusing during conveying. An external member 70 at the reversing unit 59 is provided with a reversing opening 60. The sheet s having the image formed on the front face thereof by an image formation unit 55, is sent to the reversing unit 59. The conveying direction of the sheet s is reversed at the reversing unit 59, the sheet s being partially exposed from the reversing opening 60 to the outside of an apparatus main body 100A. After that, the sheet s is sent to a re-conveying path 107. Then, the sheet s is conveyed to a secondary transfer unit 56 again, and the image is formed on the back face of the sheet s. In reversing the conveying direction of a sheet s, part of the sheet s is exposed from the reversing opening 60 to the outside of the apparatus main body 100A, so that the space that the apparatus main body 100A occupies can be reduced. However, in the third embodiment, there are two opening portions from which noise leaks, the two opening portions being a discharging port 58 and the reversing opening 60.

Figure 6:
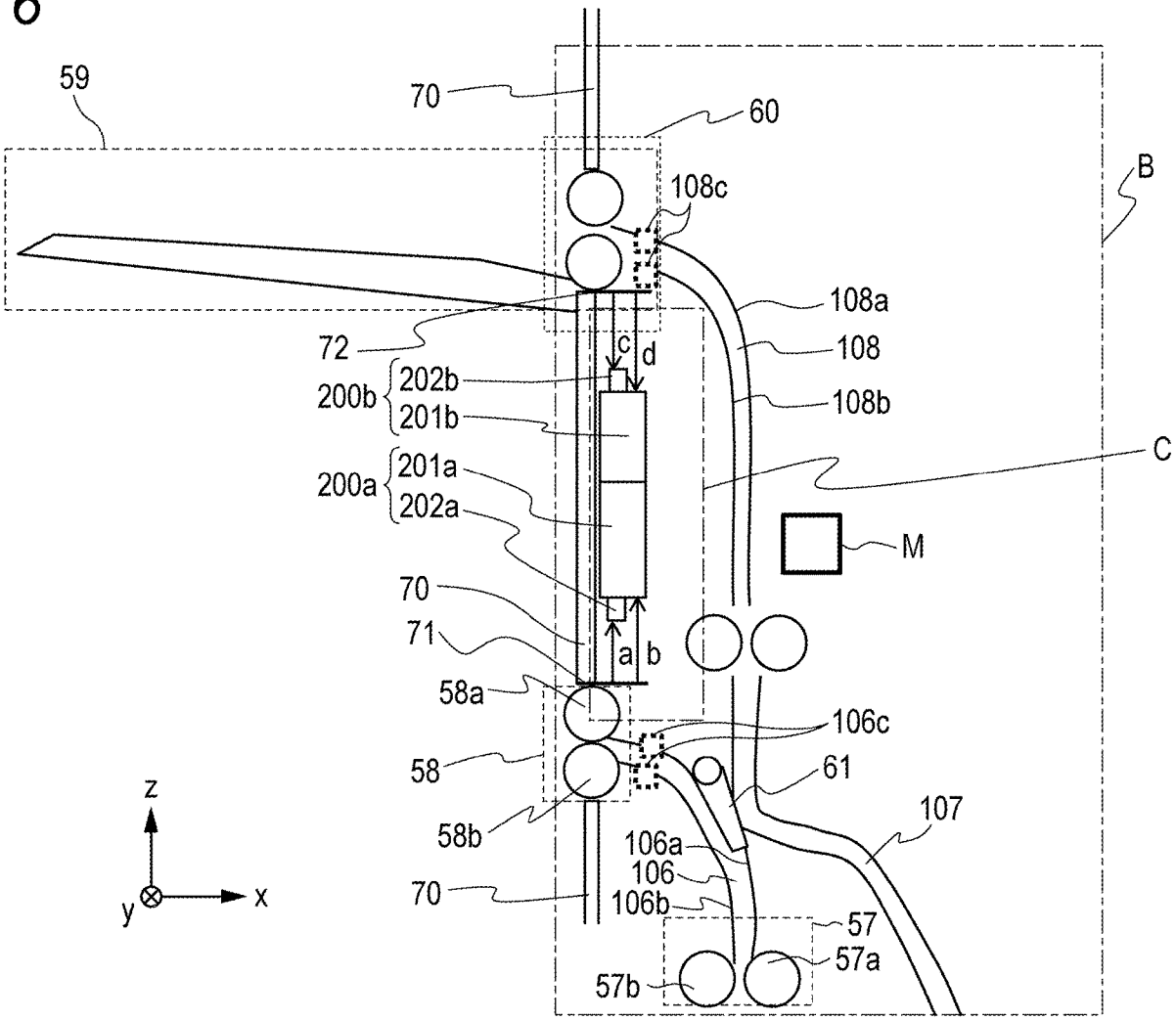
FIG. 6 is a schematic view of the neighborhood of a discharging port in the third embodiment.

FIG. 6 is a schematic view of the neighborhood of a fusing unit 57, the discharging port 58, and the reversing unit 59 in FIG. 5. FIG. 7 is a perspective view for describing the configuration of Helmholtz resonators 200*a* and 200*b* according to the third embodiment.

In the third embodiment, the two opening portions are formed at the discharging port 58 and the reversing unit 59, and thus the number of locations from which noise leaks is larger than that of the first embodiment. As illustrated in FIG. 6, the Helmholtz resonators 200*a* and 200*b* are disposed at two locations in space B on the downstream side with respect to the fusing unit 57 and on the upstream side with respect to the external member 70 forming the discharging port 58. The space B includes space in the neighborhood of the sheet ejection path 106 or the reversing path 108, downstream of the fusing unit 57 in the conveying direction of a sheet s. The disposition of the Helmholtz resonators 200*a* and 200*b* in the space B means that the Helmholtz resonators 200*a* and 200*b* are disposed in the neighborhood of the discharging port 58, inside the apparatus main body 100A. In the present embodiment, the Helmholtz resonators 200*a* and 200*b* are disposed in particular in a region C surrounded by a sheet discharging guide 106*a*, the reversing path guide 108*b*, and the external member 70 in the space B. The region C is opposed to the sheet ejection path 106 and the reversing path 108. Thus, the disposition of the Helmholtz resonators 200*a* and 200*b* in the region C allows space to be more effectively used than disposition of the Helmholtz resonators 200*a* and 200*b* in the space B excluding the region C does.

The Helmholtz resonators 200*a* and 200*b* have communicating portions 202*a* and 202*b* and cavity portion 201*a* and 201*b*, respectively. The Helmholtz resonators 200*a* and 200*b* are adhesively secured to the external member 70. The Helmholtz resonator 200*a* is disposed such that the communicating portion 202*a* faces the sheet discharging guide 106*a* and the discharging port 58. The Helmholtz resonator 200*b* is disposed such that the communicating portion 202*b* faces the reversing path guide 108*b* and the reversing opening 60.

The distance between the plane on the near side to the discharging port 58, of the communicating portion 202*a* of the Helmholtz resonator 200*a* and a face 71 that is the end face on the near side to the Helmholtz resonator 200*a*, of the external member 70 forming the discharging port 58, is defined as a distance a. The distance between the face on the near side to the discharging port 58, of the cavity portion 201*a* and the face 71, is defined as a distance b. In this case, the Helmholtz resonator 200*a* is disposed such that the distance a is shorter than the distance b. The distance between the plane on the near side to the reversing opening 60, of the communicating portion 202*b* of the Helmholtz resonator 200*b* and a face 72 that is the end face on the near side to the Helmholtz resonator 200*b*, of the external member 70 forming the reversing opening 60, is defined as a distance c. The distance between the face on the near side to the reversing opening 60, of the cavity portion 201*b* and the face 72, is defined as a distance d. In this case, the Helmholtz resonator 200*b* is disposed such that the distance c is smaller than the distance d.

Figure 7:
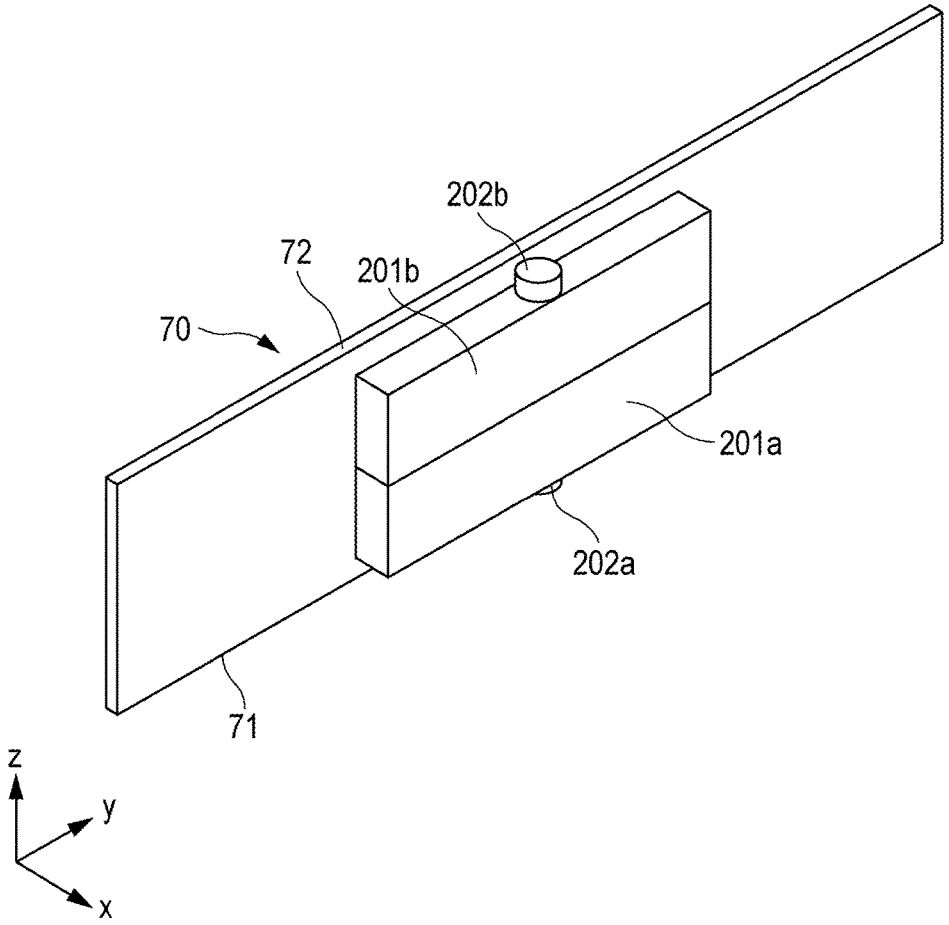
FIG. 7 is a perspective view of a configuration of the Helmholtz resonators in the third embodiment.

As illustrated in FIGS. 5, 6, and 7, the communicating portions 202*a* and 202*b* of the Helmholtz resonators 200*a* and 200*b* are disposed facing the discharging port 58 and the reversing opening 60, respectively, so that the noise that leaks from the two locations that are the discharging port 58 and the reversing opening 60 can be effectively suppressed.

Figure 8A:
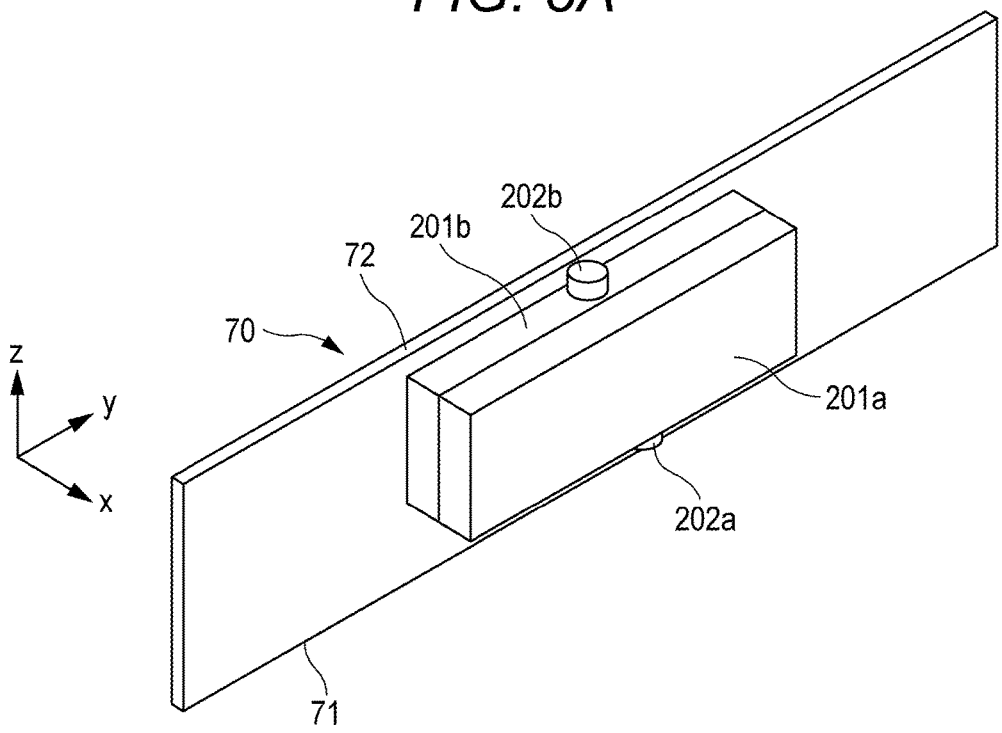
FIG. 8A is a perspective view of another configuration of the Helmholtz resonators in the third embodiment.
Figure 8B:
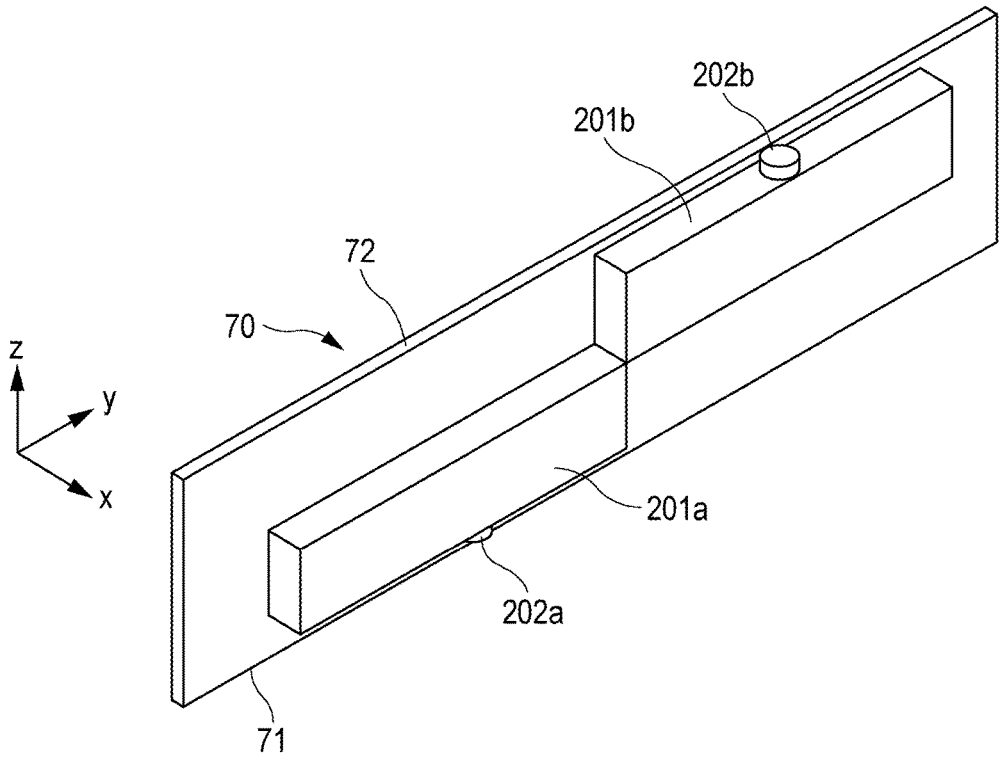
FIG. 8B is a perspective view of still another configuration of the Helmholtz resonators in the third embodiment.

Note that, in the present embodiment, a target frequency is, but is not limited to this, driving sound due to a drive motor M. The parameters of the Helmholtz resonators 200*a* and 200*b* may be determined such that the target frequency agrees with the frequency of noise to be suppressed. In terms of shape, the communicating portions 202*a* and 202*b* are not necessarily cylindrical, and the cavity portions 201*a* and 201*b* are not necessarily cuboid. FIGS. 8A and 8B illustrate modifications of the disposition of the Helmholtz resonators 200*a* and 200*b*. As in FIG. 8A, the Helmholtz resonators 200*a* and 200*b* may be disposed one on another in the x direction. As in FIG. 8B, the Helmholtz resonators 200*a* and 200*b* may be disposed shifted mutually in the y direction and in the z direction. In the third embodiment, a through-hole 106*c* of the sheet discharging guide 106*a* and the communicating portion 202*a* are spaced apart, and the through-hole 108*c* of the reversing path guide 108*b* and the communicating portion 202*b* are spaced apart. However, the third embodiment is not limited to this. As in the second embodiment, the through-hole 106*c* and the communicating portion 202*a* may be connected together and the through-hole 108*c* and the communicating portion 202*b* may be connected together.

Note that, as described in the first embodiment, the method of securing the Helmholtz resonators 200*a* and 200*b* and the shapes of the Helmholtz resonators 200*a* and 200*b* can be appropriately changed.

Fourth Embodiment

Figure 9:
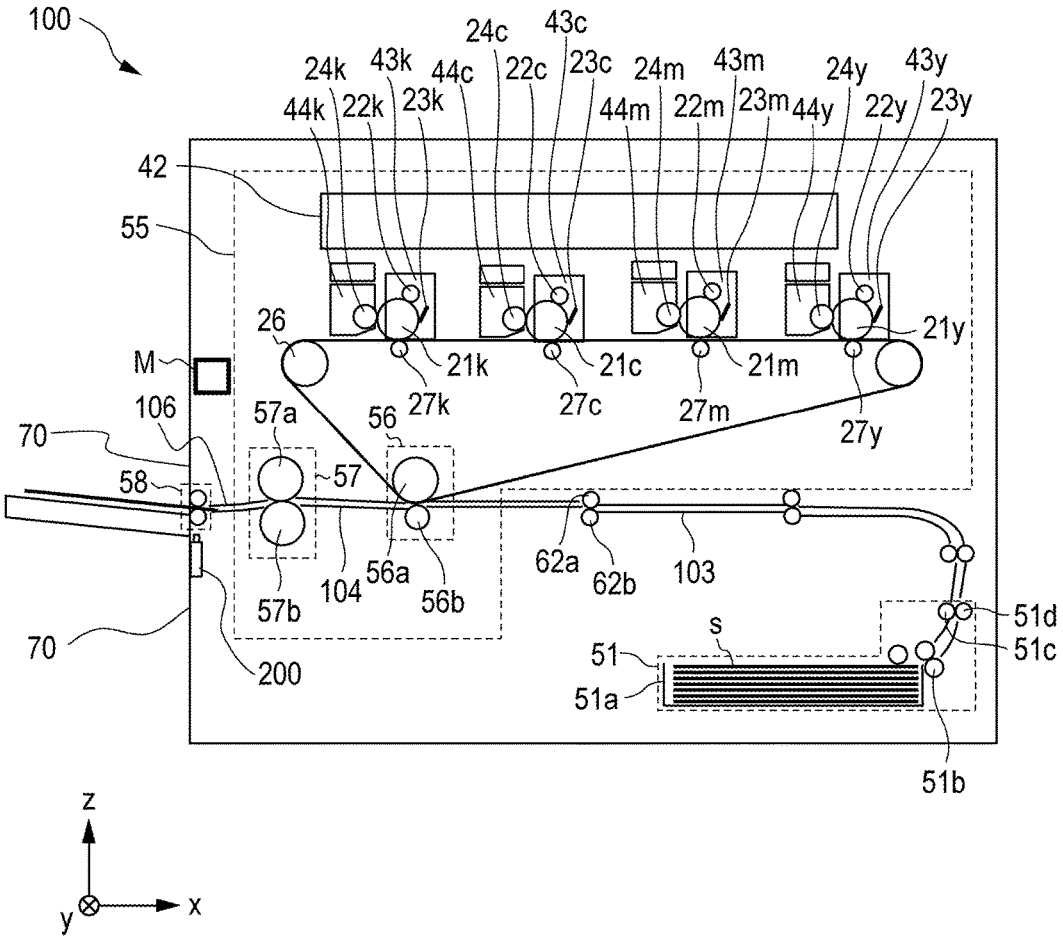
FIG. 9 is a schematic view of an image forming apparatus including a Helmholtz resonator in a fourth embodiment.
Figure 10:
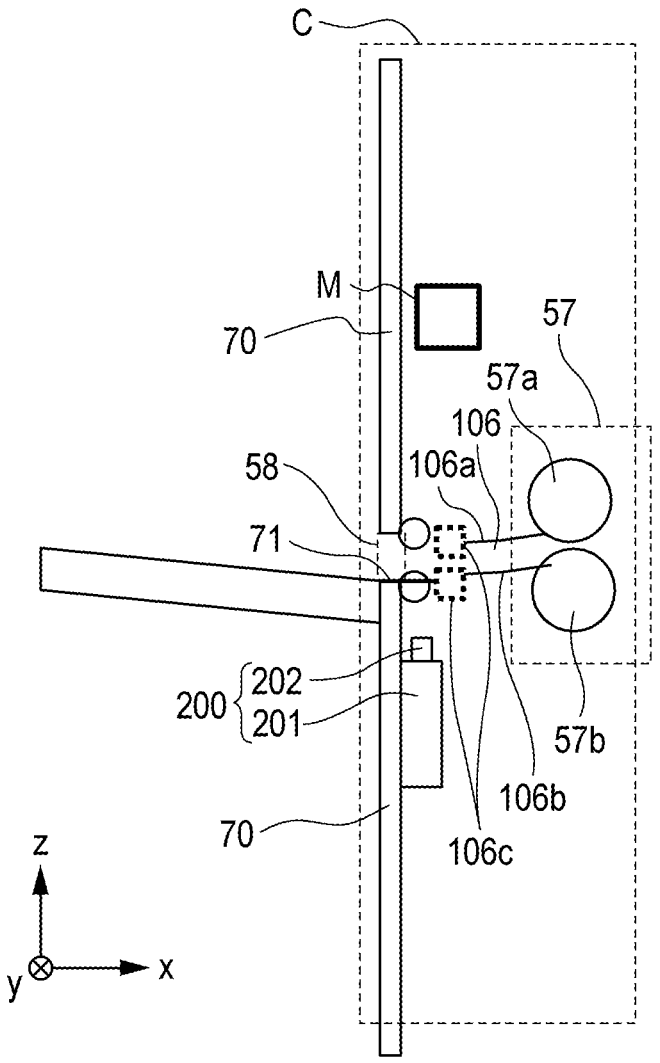
FIG. 10 is a schematic view of the neighborhood of a discharging port in the fourth embodiment.

A fourth embodiment will be described with FIGS. 9 and 10. FIG. 9 is a schematic view of an image forming apparatus 100. FIG. 10 is an enlarged view of the neighborhood of a fusing unit 57 and a discharging port 58. The fourth embodiment is different from the first embodiment in terms of the conveying direction of a sheet s. Differently from the first embodiment, a single function printer having no image reading unit 41 is given. The descriptions for configurations similar to those of the first embodiment, will be omitted. In the first embodiment, a sheet s is conveyed substantially in the z direction until sheet-discharging from the discharging port 58. Meanwhile, differently, in the fourth embodiment, the conveying direction of a sheet s is substantially the x direction except in a sheet feeding and separating process. A sheet s fed and separated from a cassette 51*a* is nipped and conveyed by drawing roller pair 51*c* and 51*d*. Then, the sheet s is conveyed by a pair of an inner secondary transfer roller 56*a* and an outer secondary transfer roller 56*b* and a pair of a fusing roller 57*a* and a fusing backup roller 57*b* through a pre-secondary-transfer conveying path 103. After that, the sheet s is discharged from the opening portion of the discharging port 58. In order to release the heat or the vapor of the sheet surfaces after fusing, a through-hole 106*c* including a large number of through-holes in the y direction, opening in the z direction, is provided at each of the conveying surfaces of sheet discharging guides 106*a* and 106*b* forming a sheet ejection path 106.

A Helmholtz resonator 200 is disposed in a region of space C, downstream of the fusing unit 57 and upstream of an external member 70 forming the discharging port 58. Similarly to the first embodiment, the Helmholtz resonator 200 is disposed such that the opening side of a communicating portion 202 of the Helmholtz resonator 200 faces the discharging port 58. The communicating portion 202 is disposed in the neighborhood of the through-hole 106*c* provided at the sheet discharging guide 106*b* forming the sheet ejection path 106. Thus, the communicating portion 202 and the sheet ejection path 106 are spatially in communication through the through-hole 106*c*.

As in FIGS. 9 and 10, the disposition of the Helmholtz resonator 200 allows a sound-suppression effect to be achieved in the image forming apparatus 100 in which a sheet s is conveyed substantially in the x direction as illustrated in the fourth embodiment.

Note that, as in the second embodiment, the through-hole 106*c* and the communicating portion 202 may be connected together. As described in the first embodiment, the method of securing the Helmholtz resonator 200 and the shape of the Helmholtz resonator 200 can be appropriately changed.

While the present disclosure has been described with reference to embodiments, it is to be understood that the disclosure is not limited to the disclosed embodiments. The scope of the following claims is to be accorded the broadest interpretation so as to encompass all such modifications and equivalent structures and functions.

This application claims the benefit of Japanese Patent Application No. 2017-206272, filed Oct. 25, 2017, which is hereby incorporated by reference herein in its entirety.

What is claimed is:

1. An image forming apparatus comprising:

a transfer unit configured to transfer a toner image onto a sheet;

a fusing unit configured to fuse the toner image on the sheet;

a discharging unit configured to discharge the sheet passed through the fusing unit;

a guide member provided downstream of a fusing position, where the toner image is to be fused onto the sheet by the fusing unit, and upstream of a discharge position where the sheet is to be discharged by the discharging unit in a conveying direction of the sheet, wherein the guide member includes a through-hole at a conveying surface; and a Helmholtz resonator having a cavity portion and a communicating portion through which the cavity portion is configured to be in communication with an outside area that is exterior to the Helmholtz resonator, wherein the Helmholtz resonator is disposed downstream of the fusing position and upstream of the discharging position in the conveying direction of the sheet.

2. The image forming apparatus according to claim 1, wherein the Helmholtz resonator is disposed such that a distance a is shorter than a distance b, wherein the distance a is a distance between a plane on a near side to an opening portion of the communicating portion, and an end face on a near side to the Helmholtz resonator of an external member forming the opening portion, and wherein the distance b is a distance between a face on the near side to the opening portion of the cavity portion, and the end face on the near side to the Helmholtz resonator of the external member forming the opening portion.

3. The image forming apparatus according to claim 1, wherein an end portion of the communicating portion and an end portion of the through-hole of the guide member are provided in contact with each other.

4. The image forming apparatus according to claim 1, wherein the communicating portion faces the through-hole of the guide member.

5. The image forming apparatus according to claim 1, further comprising a discharging port from which the sheet is to be discharged by the discharging unit, wherein the communicating portion faces the discharging port.

6. The image forming apparatus according to claim 1, wherein the Helmholtz resonator and a conveying path of the sheet guided by the guide member are spatially connected through the through-hole.

7. The image forming apparatus according to claim 1, wherein the fusing unit includes a fusing roller and a fusing backup roller and conveys the sheet between the fusing roller and the fusing backup roller to fuse the toner image onto the sheet at the fusing position.

8. The image forming apparatus according to claim 1, wherein the discharging unit includes a discharge roller configured to discharge the sheet at the discharging position.

9. The image forming apparatus according to claim 1, further comprising a drive motor configured to drive the discharging unit, wherein the Helmholtz resonator is configured to suppress driving sound emitted through the through-hole.

10. An image forming apparatus comprising:

a transfer unit configured to transfer a toner image onto a sheet;

a fusing unit configured to fuse the toner image on the sheet;

an external member forming a first opening portion to discharge the sheet passed through the fusing unit and a second opening portion to expose part of the sheet outward in reversing a conveying direction of the sheet, wherein, in a case where the toner image is fused on the sheet, the sheet includes an image fused on a first face;

a discharging roller configured to discharge the sheet from the first opening portion;

a first guide member provided on a downstream side with respect to the fusing unit and on an upstream side with respect to the first opening portion in the conveying direction of the sheet, wherein the first guide member includes a first through-hole at a conveying surface and is configured to guide the sheet to the first opening portion;

a second guide member provided downstream of the fusing unit and upstream of the second opening portion in the conveying direction of the sheet, wherein the second guide member includes a second through-hole at a conveying surface and is configured to guide the sheet to the second opening portion;

a switching member provided at a branch portion between the first guide member and the second guide member, wherein the switching member is configured to move such that the sheet is conveyed to the first guide member or the second guide member;

a first Helmholtz resonator having a first cavity portion and a first communicating portion through which the first cavity portion is configured to be in communication with an outside area that is exterior to the first Helmholtz resonator; and a second Helmholtz resonator having a second cavity portion and a second communicating portion through which the second cavity portion is configured to be in communication with an outside area that is exterior to the second Helmholtz resonator, wherein the first Helmholtz resonator and a conveying path of the sheet guided by the first guide member are connected through the first through-hole, wherein the second Helmholtz resonator and a conveying path of the sheet guided by the second guide member are connected through the second through-hole, wherein the first Helmholtz resonator and the second Helmholtz resonator are disposed on the downstream side with respect to the fusing unit and on an upstream side with respect to the external member in the conveying direction of the sheet, and wherein the first Helmholtz resonator is disposed such that the first communicating portion faces the first guide member, and the second Helmholtz resonator is disposed such that the second communicating portion faces the second guide member.

11. The image forming apparatus according to claim 10, wherein the first Helmholtz resonator and the second Helmholtz resonator are disposed in a region surrounded by the first guide member, the second guide member, and the external member.

12. The image forming apparatus according to claim 10, wherein the first Helmholtz resonator is disposed such that a distance a is shorter than a distance b, and the second Helmholtz resonator is disposed such that a distance c is shorter than a distance d, wherein the distance a is a distance between a plane on a near side to the first opening portion of the first communicating portion, and an end face on a near side to the first Helmholtz resonator of the external member forming the first opening portion, wherein the distance b is a distance between a face on the near side to the first opening portion of the first cavity portion, and the end face on the near side to the first Helmholtz resonator of the external member forming the first opening portion, wherein the distance c is a distance between a plane on a near side to the second opening portion of the second communicating portion, and an end face on a near side to the second Helmholtz resonator of the external member forming the second opening portion, and wherein the distance d is a distance between a face on the near side to the second opening portion of the second cavity portion, and the end face on the near side to the second Helmholtz resonator of the external member forming the second opening portion.

13. The image forming apparatus according to claim 10, wherein an end portion of the first communicating portion and an end portion of the through-hole of the first guide member are provided in contact with each other, and an end portion of the second communicating portion and an end portion of the through-hole of the second guide member are provided in contact with each other.

14. The image forming apparatus according to claim 10, wherein the first Helmholtz resonator and the second Helmholtz resonator are disposed arrayed in a rotational axial direction of the discharging roller.

15. The image forming apparatus according to claim 10, wherein the first Helmholtz resonator and the second Helmholtz resonator are disposed arrayed in a height direction.

16. The image forming apparatus according to claim 10, wherein the first Helmholtz resonator and the second Helmholtz resonator are disposed arrayed in a direction orthogonal to a rotational axial direction of the discharging roller and a height direction.

17. The image forming apparatus according to claim 10, further comprising a drive motor configured to drive the discharging roller, wherein a target frequency of the first Helmholtz resonator is set such that sound generated by the drive motor is suppressed.

18. The image forming apparatus according to claim 10, further comprising a drive motor configured to drive the discharging roller, wherein a target frequency of the second Helmholtz resonator is set such that sound generated by the drive motor is suppressed.

* * * * *